US005540607A

United States Patent [19]

Breivik et al.

[11] Patent Number: 5,540,607

[45] Date of Patent: Jul. 30, 1996

[54] DEVICE FOR GUIDING A LOADING/UNLOADING BUOY INTO A RECEIVING SPACE AT THE BOTTOM OF A VESSEL

[75] Inventors: Kare Breivik, Tau; Harald Kleppesto, Bryne; Arne Smedal, Farvik, all of Norway

[73] Assignee: Den Norske Stats Oljeselskap A.S., Stavanger, Norway

[21] Appl. No.: 374,614

[22] PCT Filed: Jul. 23, 1993

[86] PCT No.: PCT/NO93/00118

§ 371 Date: Mar. 29, 1995

§ 102(e) Date: Mar. 29, 1995

[87] PCT Pub. No.: WO94/02351

PCT Pub. Date: Feb. 3, 1994

[51] Int. Cl.[6] ..... B63B 22/02

[52] U.S. Cl. ..... 441/5; 114/230

[58] Field of Search ..... 441/3–5; 114/230

[56] References Cited

U.S. PATENT DOCUMENTS

| | | | |
|---|---|---|---|
| 4,765,378 | 8/1988 | Engelskirchen et al. | 441/5 |
| 4,892,495 | 1/1990 | Svensen | 441/5 |
| 5,292,271 | 3/1994 | Boatman et al. | 441/3 |

*Primary Examiner*—Jesus D. Sotelo
*Attorney, Agent, or Firm*—Keck, Mahin & Cate

[57] ABSTRACT

A device for guiding a loading/unloading buoy during pulling-up into a receiving space in the bottom of a vessel. The device includes a guide cylinder which is vertically moveable in a shaft in the vessel. The guide cylinder is extend into the receiving space such that guide elements on the guide cylinder provide side stabilization of the buoy as it is brought into the receiving space.

12 Claims, 3 Drawing Sheets

Figure 1:
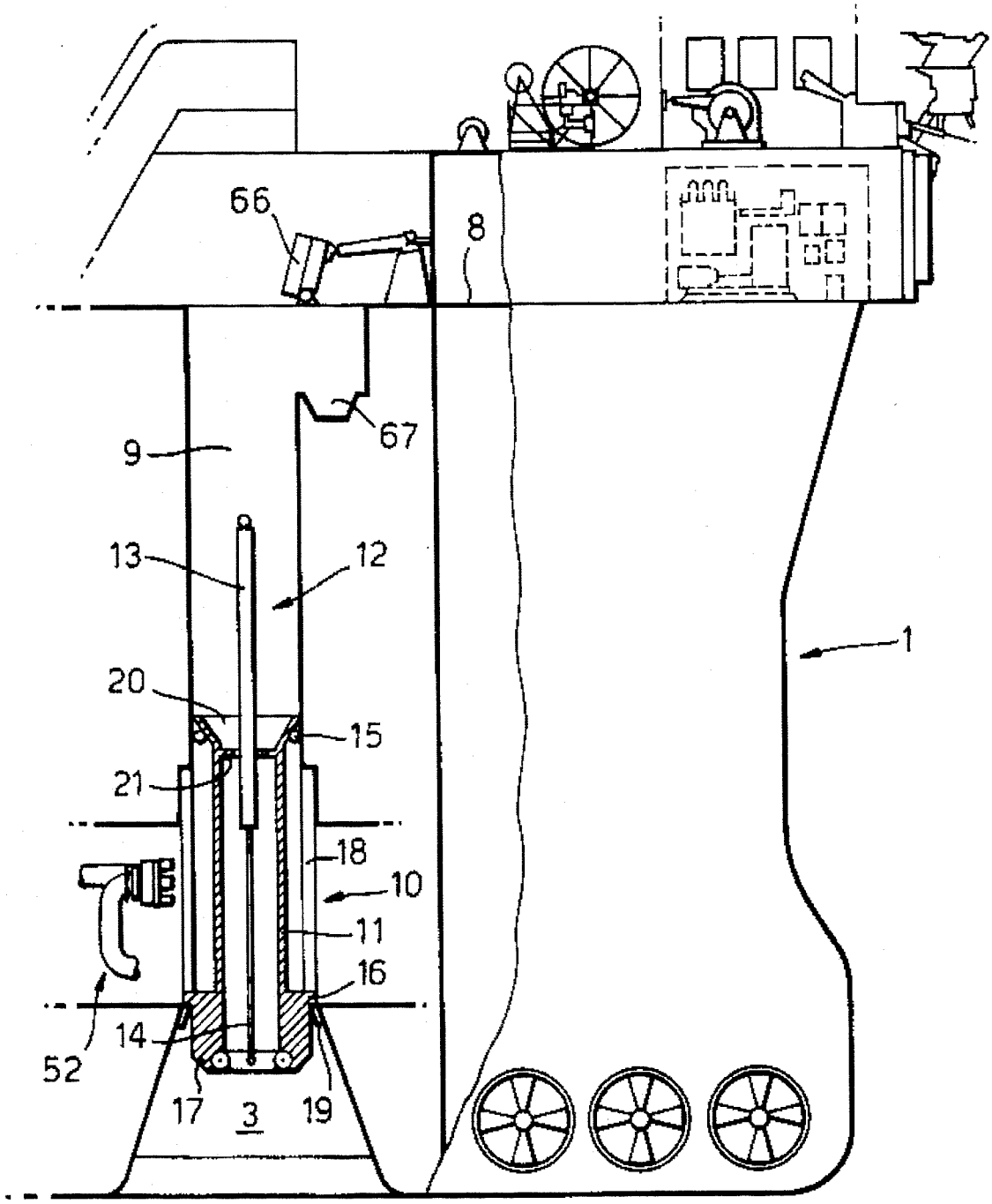

DEVICE FOR GUIDING A LOADING/UNLOADING BUOY INTO A RECEIVING SPACE AT THE BOTTOM OF A VESSEL

The present invention relates to a device of which the main component is a guide cylinder having a circular or possibly other cross-sectional shape and which can be displaced relative to an air-tightly closable shaft above a receiving space at the bottom of the vessel. The receiving space is adapted to the outer shape of the loading/unloading buoy, and the objective of the device of the invention especially is to provide for a reliable and gentle guiding during the pulling-up of the buoy to the correct position in the receiving space, whereafter locking can take place.

The loading/unloading buoy all the time is anchored by lines to the sea bed. From the bottom of the buoy, a transfer line in the form of a flexible riser extends down to an installation or something else on the sea bed. The flowable medium normally will be hydrocarbons (oil or gas), possibly also other flowable materials, for example in powder or particle form.

The transfer of medium takes place in that the buoy is pulled up into the receiving space in the bottom of the vessel and locked in place, whereafter a coupling unit which is connected to the tube system of the vessel, is connected.

Such a system for The connection of a loading buoy to a floating vessel and transfer of medium to/from the vessel, is already known from the international patent applications PCT/NO92/00053 and . . . 054, a vessel which is especially arranged for such connection and transfer is described in the corresponding application . . . 055, and finally, a loading/unloading buoy which is adapted to be received in the receiving space of such a vessel is described in the corresponding application . . . 056.

The technique described therein already involves substantial advantages for the transfer of medium, and especially the transfer itself as well as the connection/disconnection will be able to be carried out under partly very difficult weather and sea conditions. In order to facilitate and make safe the critical phase when the buoy during the pulling-up for connection in the vessel has arrived at the level of the bottom of the vessel, to thereafter be introduced into the receiving space in the bottom, it has turned out, however, that there is a need for better facilities for guiding. In the solutions-according to the prior art, there is primarily taken care that the receiving space has an appropriate shape and surface structure, so that a buoy having a corresponding shape and surface will be able to be moved in place without any appreciable risk for damages or misalignments. A generally conical outer shape of the buoy, possibly divided into parts having different conicity, will be preferable, and corresponding considerations will apply to the internal shape of the receiving space. Another means is that the pick-up line pulling the loading/unloading buoy up into the vessel, is centred and consequently secondarily causes a guiding of the buoy itself. If the pick-up line at the bottom branches off and forms a so-called lifting bridle having several lines, e.g. in a number of three, the buoy secondarily will be able to be guided in place even better. This principle is additionally utilized in the invention, and the guide elements with which the inventive device is equipped, is precisely suitable for causing guiding by means of a pick-up line which, at the pick-up end, forms a lifting bridle having converging lines.

Generally, the device of the invention, for guiding of a loading/unloading buoy during its pulling-up or lowering to/from a locked position in the receiving space of the vessel, wherein the guiding takes place by means of guide elements and wherein the vessel above the receiving space has an airtightly closable shaft for connection, inspection and maintenance, especially is characterized by arranging the guide elements are arranged on a guide cylinder which is displaceable coaxially relative to the closable shaft and in the longitudinal direction thereof from an upper, retracted position of rest via a guiding region to a lower, advanced end position, and by means for power-assisted displacement of the guide cylinder to a desired position in or between its rest and end positions, a stop means for determining the advanced end position of the guide cylinder, stabilizing elements for side stabilization of the guide cylinder, and facilities for monitoring of the guide elements. These characterizing features incidentally form the characterizing portion of the drawn-up claim 1. Further characteristics of the invention are drawn up in the subsequent sub-claims.

By installing in this manner a displaceable guide cylinder for guiding the loading/unloading buoy and the lines thereof, one avoids some of the problems experienced in rough sea during the pulling-up, namely that the buoy runs the risk of being deformed as a result of strong bumping against the sides of the receiving space. This in turn is due to the fact that the guide elements for the line and the lifting bridle have been placed relatively high up in the shaft above the receiving space, whereby a pendulum movement with a long swinging arm takes place. The problem is solved in and by the invention in that the pivot axis for such pendulum movement is brought quite down to the buoy and the lifting bridle, by arranging the guide elements at the lower end of a lowerable guide cylinder. Thus, during the pulling-up of the buoy, the guide cylinder is moved "to meet" the buoy, and insures that the pendulum movement gets a sufficiently short swinging arm so that impacts between the buoy and the walls of the receiving space are prevented. As the pulling-up proceeds, as the guide cylinder is hoisted up, and the hoisting continues also after the buoy has been locked in place in the receiving space. This last phase of the hoisting liberates a sufficiently high free region at the lower end of the shaft so that connection, inspection and maintenance may be carried out at the underside of the guide cylinder.

The guide cylinder may have a circular or rectangular cross-section. Preferably, it is mounted at the inner side of the service shaft, but a solution wherein it is displaceable on the outside thereof, may also be contemplated.

In order to utilize the invention it is presupposed, as mentioned in the introduction, that the topical vessel either already has a "receiving module" comprising a receiving space in the bottom, and a service shaft thereabove, or such a module when required is built into an already existing, conventional vessel. This is further described in the aforementioned patent application PCT/NO92/00055. If the module is of an "early" type, a relatively modest additional installation (guide rails, a storage place for lines and buoys, a possible stop means, a fastening for an actuator) can make it suitable for the guiding device of the invention.

Figure 2:
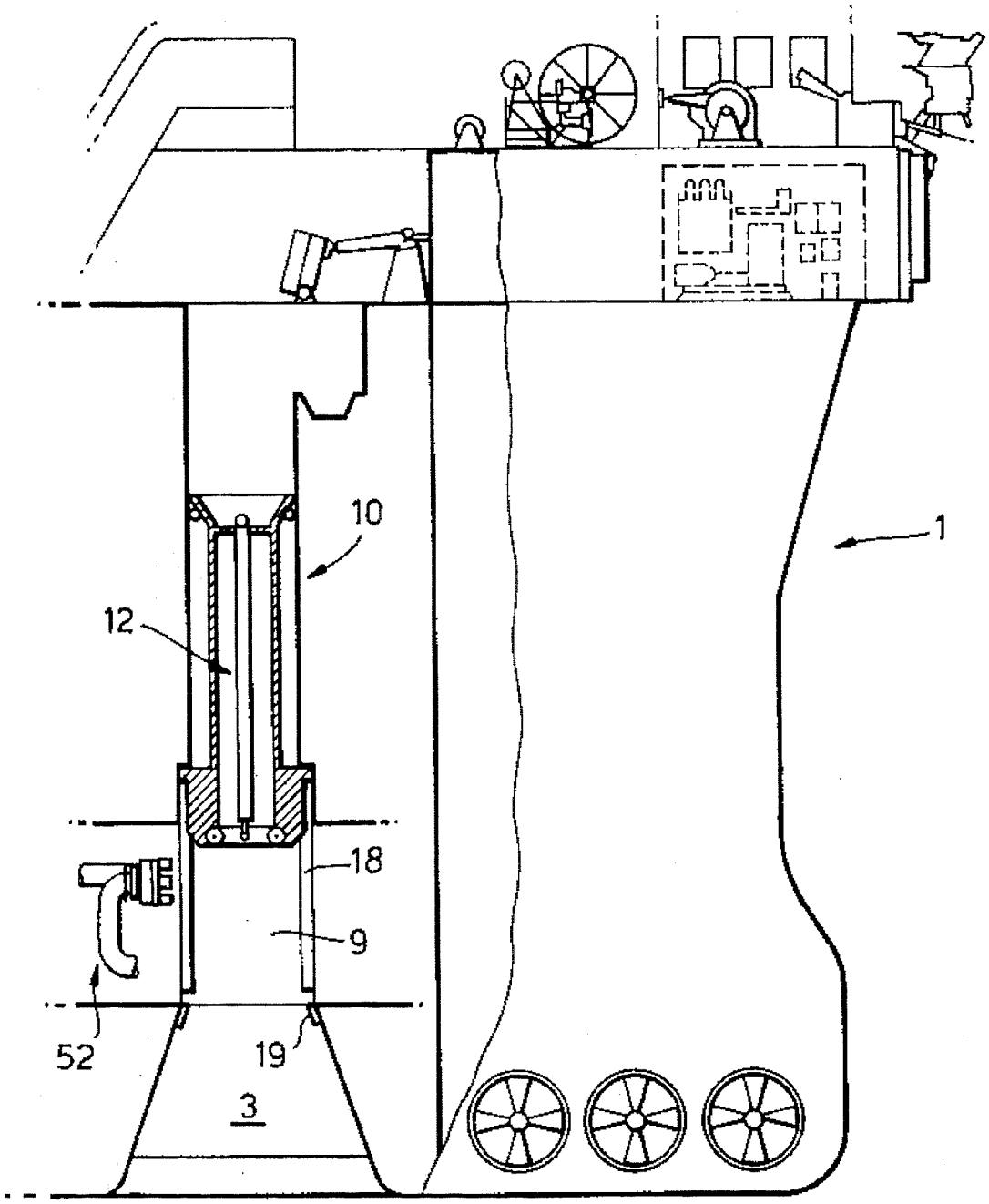
Figure 3:
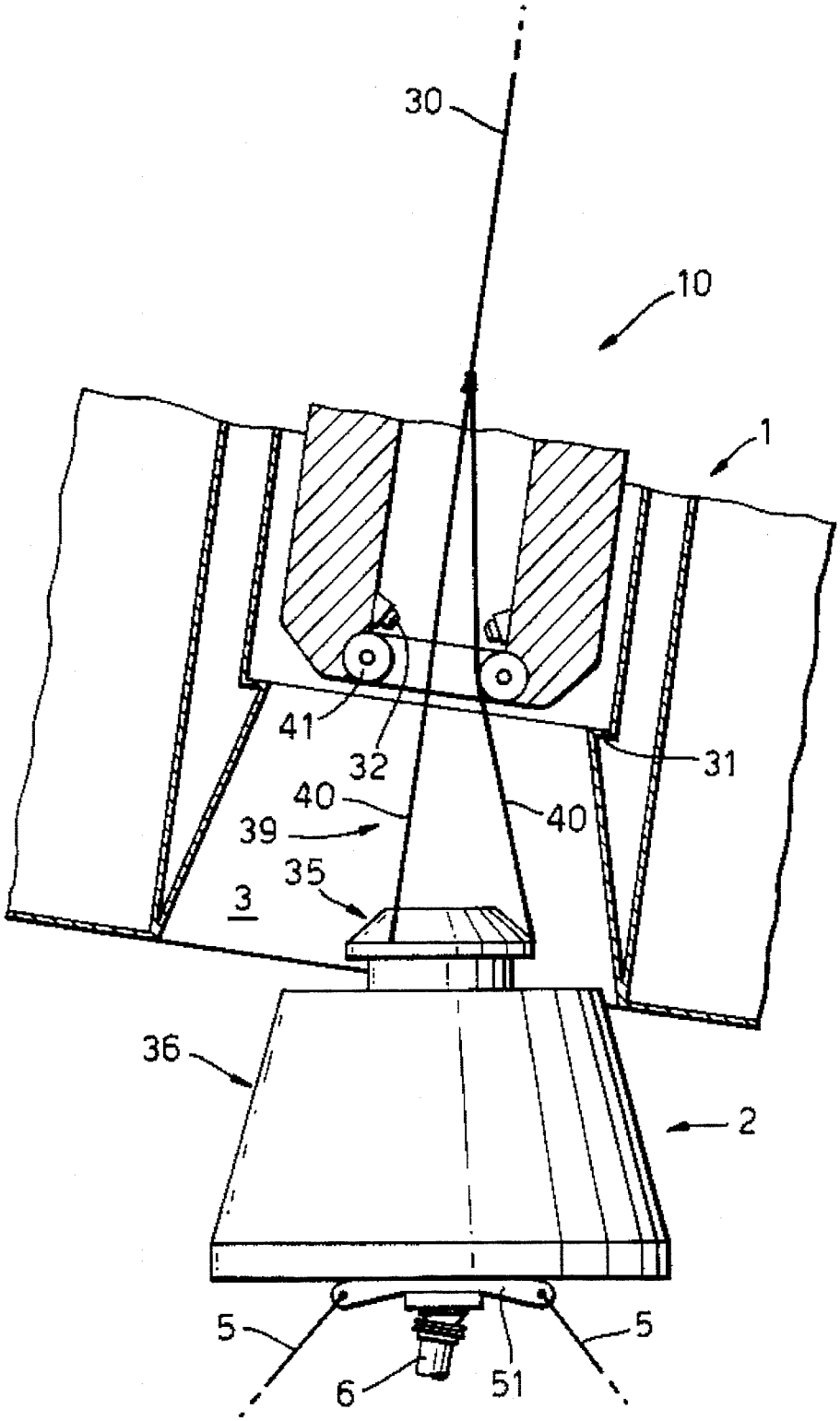

The invention will now be examined in further detail by describing in the first place a preferred embodiment; this is also illustrated in the appertainent drawings, wherein FIG. 1 shows the bow portion of a larger vessel having a conical receiving space in the bottom and a shaft thereabove, the vessel being adapted for receiving a loading/unloading buoy and being equipped with a device of the invention for the guiding thereof, and wherein the figure shows the guide cylinder of the device in its lower end position;

FIG. 2 shows the same, but in this case with the guide cylinder in its upper position of rest; and FIG. 3 shows a section of the bottom of a vessel in movement in heavy sea, during pulling-up of a loading/unloading buoy, the figure showing a situation wherein the guide elements of the guide cylinder in the form of rollers are moved so far downwards towards the buoy that one line of the lifting bridle is bent inwards.

FIG. 1 shows a section of the bow portion of a vessel 1 having a receiving space 3 in the bottom. The vessel is a tanker, e.g. a so-called shuttle tanker, and the receiving space 3 is adapted for receipt of a loading/unloading buoy for the transfer of e.g. oil or gas. The Figure does not show the buoy. In the initial situation, the buoy is anchored to the sea bed and is located so deeply that it can not represent any danger to sea going traffic. The first phase of the transfer of the flowable medium, such as oil, is initiated in that the vessel 1 is moved to a position in which the receiving space 3 will be located approximately directly above the anchored loading/unloading buoy. In the bow of the shown vessel, there are suggested three juxtaposed propellers, so-called bow thrusters which, together with the main propeller of the vessel and a possible dynamic positioning system, provide for the correct position. In a suitable manner, e.g. by means of a sink line and/or auxiliary lines, the pick-up line of the buoy is caught and pulled up through the receiving space 3 and the access or service shaft 9 extending upwards therefrom and up to the deck 8 of the vessel. The service shaft 9 is tightly closeable by shutters, of which an uppermost shutter 66 is indicated in the Figure. At the upper end of the shaft 9 there is preferably arranged a laterally disposed storage place 67 for a spare line with possible marking buoys.

The device of the invention for guiding the buoy in place during the pulling-up, and which will also be able to be used for guiding when releasing and lowering the buoy, is generally given the reference numeral 10 and has, as a main member, a guide cylinder 11 which is arranged coaxially relative to the closable service shaft 9 and is displaceable in the longitudinal direction thereof from an upper, retracted position of rest (shown in FIG. 2) via a guiding region wherein guiding of the loading/unloading buoy can take place, to a lower, projecting or advanced end position which is the position shown in FIG. 1. The displacement movement is effected by means of one or more long cylinder actuators 12, preferably of hydraulic type. The actuators 12 have their power cylinder 13 fastened at the upper end to the hull of the vessel, and their piston rod 14 is connected at its lower end to the lowermost part of the guide cylinder 11. The range of movement of the cylinder actuators and the guide cylinder must be so large that the cylinder, in its advanced end position and in the guiding region thereabove, provides a good guiding of the pick-up line and lifting bridle of the buoy already early in the pulling-up phase when the upper part of the buoy is introduced into the receiving space 3. Simultaneously, the guide cylinder 11 must be able to be pulled so high up that an accessible space for maintenance personnel is formed at the lower end of the service shaft 9 and at the underside of the guide cylinder. In this space also the connection between the buoy and the pipe system of the vessel takes place. In FIGS. 1 and 2, such a connection is indicated by a U-shaped pivotable coupling unit 52.

As indicated in FIG. 1, lateral stabilization of the guide cylinder 11 takes place by means of upper stabilizing rollers 15 and lower stabilizing lugs 16. These may be distributed around the circumference of the lower, enlarged portion 17 of the guide cylinder 11 or, instead of separate stabilizing lugs, there may be arranged a continuously encircling guide flange. In addition to, or partly in substitution for the stabilizing lugs 16 or parts of the stabilizing flange, there may also be mounted stabilizing rollers at the lower end of the guide cylinder. Thus, the purpose of the rollers, lugs, flange or the like is stabilization, i.e. a lateral support at the same time as a vertical movement is allowed. In the illustrated embodiment, the guide cylinder 11 is arranged within the service shaft 9. An alternative solution may be to allow the guide cylinder completely or partly to surround the shaft. In that case the stabilizing elements will be arranged at the inside and bear against corresponding elements at the outside of the shaft. In the illustrated embodiment there are shown a pair of opposite slide rails 18 for guiding of the stabilizing lugs 16, whereas the upper stabilizing rollers 15 are shown with direct contact against the opposite walls of the service shaft.

The lower end position of the guide cylinder is determined in that the stabilizing lugs 16 or the stabilizing flange will bear against especially arranged stop lugs 19 or a corresponding encircling flange.

At the upper end of the service shaft 9 there is located a storage place 67 for auxiliary pick-up lines and marking buoys. This storage place may be funnel shaped, as shown. During loading, when the shutter 66 is closed, an auxiliary line normally will be fastened to the pick-up line 30, so that the buoy 2 can be freely dropped in an emergency situation.

At the upper end the guide cylinder 11 has a funnel-shaped enlargement 20 having an internal bottom 21 with a central opening. Such a funnel shape may be practical for several reasons, among other things in order that pick-up lines with buoys can be passed freely through the guide cylinder from the storage place 67 at the upper end of the shaft 9.

FIG. 3 schematically shows how the guiding of a loading/unloading buoy 2 may be carried out by means of the device 10 of the invention. In the illustrated embodiment, the buoy 2 consists of an upper 35 and a lower conical part 36. Further, the buoy has a lifting bridle 39 having e.g. three fastening lines 40, in the Figure fastened with an angular distance of 120° around the periphery of the upper cone member 35. (In the Figure, the rearward left fastening line 40 is covered by the forward one.) The fastening lines converge upwards and are fastened together at their upper end to a single pick-up line 30. As a result of the fact that the lifting bridle 39 has at least two fastening lines 40, there is—in a way—formed an extension of the outer conical shape of the buoy.

Further, FIG. 3 shows the mooring lines 5 of the buoy which are fastened to a reinforced portion 51 at the underside of the lower cone member 36, and a transfer line 6 is suggested at the underside of the buoy. In the shown situation the buoy is vertical, whereas the vessel 1 rolls or pitches considerably, so that the introduction of the buoy in the receiving space 3 becomes more or less oblique. In the shown situation, the guiding device 10 of the invention has its guide cylinder 11 located in the guiding region a distance above the lower, advanced end position which is determined by abutment of the stabilizing lugs or the like against the shown stop flange 31. The actual guide elements of the guiding device especially are in the form of guide rollers 41 which, in the illustrated embodiment, are executed as an approximately continuous internal ring at the lower end of the enlarged part 17 of the guide cylinder 11. As a result of the fact that the guide rollers 41 are configured in the form of a ring, it is ensured that the fastening lines 40 all the time find rolling support, irrespective of the turning position of the buoy 2 or the outer rotatable part thereof, relative to the longitudinal direction of the vessel. Another embodiment may be that the guide rollers 41 are arranged in a pair of opposite groups which are perpendicular to each other. A special mechanism should then be provided in addition, in order to prevent the fastening lines from wedging into the corners between the individual rollers.

When the lifting bridle 39 as shown has three fastening lines arranged at an angular distance of 120°, and when the outer member of the buoy 2 simultaneously is rotatable relative to the moving lines 5 and the transfer line 6, there is obtained, in case of oblique introduction or in that the pick-up line 30 is pulled somewhat obliquely relative to the longitudinal axis of the guiding device 10, that the lifting bridle will turn to one of three positions, also having an angular distance of 120°. This may be advantageous with respect to the adaptation and locking of the buoy to the receiving space. For monitoring purposes during the pulling-up of the buoy, and possibly also during the lowering thereof, cameras 32 may be arranged at the inner side of the guide cylinder 11.

We claim:

1. A device for guiding a submerged loading/unloading buoy in a receiving space at the bottom of a floating vessel during pulling-up or lowering of the buoy to/from a locked position in the receiving space, the buoy being fastened to the sea bed by mooring lines and in the locking position being connectable to a pipe system in the vessel, and wherein the guiding takes place by means of guide elements for guiding of the movement of the buoy relative to the receiving space, said elements being arranged at the lower end of a shaft arranged in the vessel above the receiving space, wherein the guide elements are arranged on a guide cylinder which is displaceable in the longitudinal direction of the shaft and coaxially relative thereto between an upper, retracted position and a lower, advanced position, there being provided a drive means for displacement of the guide cylinder to a desired position, stabilizing elements for side stabilization of the guide cylinder, and means for monitoring of the guide elements.

2. The device of claim 1, wherein the buoy is connected to a pick-up line via a lifting bridle having converged fastening lines, and wherein the guide elements form a guide opening which is adapted for guiding contact with the pick-up line and the converging fastening lines.

3. The device of claim 1, wherein the guide elements are guide rollers forming an approximately continuous internal ring at the lower end of the guide cylinder.

4. The device of claim 2, wherein the guide elements are guide rollers forming an approximately continuous internal ring at the lower end of the guide cylinder.

5. The device of claim 1, wherein the guide elements comprise turning elements for causing turning of a rotatable outer member of the loading/unloading buoy, so that the buoy during the pulling-up assumes one of a limited number of angularly determined positions.

6. The device of claim 2, wherein the guide elements comprise turning elements for causing turning of a rotatable outer member of the loading/unloading buoy, so that the buoy during the pulling-up assumes one of a limited number of angularly determined positions.

7. The device of claim 1, wherein the guide cylinder is arranged within the shaft and rests against internal stabilizing elements.

8. The device of claim 1, wherein the stabilizing elements comprise longitudinally extending rails and rail engaging means selected from the group consisting of rollers and stabilizing lugs.

9. The device of claim 1, wherein the drive means is selected from the group consisting of hydraulic, pneumatic and electric actuators.

10. The device of claim 1, further comprising a stop means for determining the lower position of the guide cylinder.

11. The device of claim 10, wherein the stop means comprises separate stop lugs at the lower end of the shaft, and an abutment on said guide cylinder selected from the group consisting of completely or partly encircling abutment flanges.

12. The device of claim 1, wherein the means for monitoring is supported on the guide cylinder at the lower end thereof and is selected from the group consisting of underwater cameras and sensors.

* * * * *